US006300918B1

(12) United States Patent
Riddle et al.

(10) Patent No.: US 6,300,918 B1
(45) Date of Patent: Oct. 9, 2001

(54) CONFORMAL, LOW RCS, WIDEBAND, PHASED ARRAY ANTENNA FOR SATELLITE COMMUNICATIONS APPLICATIONS

(75) Inventors: Robert G. Riddle, San Diego; Allan C. Goetz, La Jolla, both of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/470,132

(22) Filed: Dec. 22, 1999

(51) Int. Cl.[7] ..... H01Q 1/36
(52) U.S. Cl. ..... 343/895; 343/855
(58) Field of Search ..... 343/895, 700 MS, 343/850, 853, 855; H01Q 1/36

(56) References Cited

U.S. PATENT DOCUMENTS 3,787,871 * 1/1974 Reese ..... 343/895
3,925,784 * 12/1975 Phelan ..... 343/754
4,114,164 * 9/1978 Greiser ..... 343/895
4,458,248 * 7/1984 Lyasko ..... 343/719
4,656,485 * 4/1987 Werner et al. ..... 343/876
5,223,849 * 6/1993 Kasevich et al. ..... 343/700 MS
5,933,121 * 8/1999 Rainhart et al. ..... 343/873

* cited by examiner

*Primary Examiner*—Don Wong
*Assistant Examiner*—Trinh Vo Dinh
(74) *Attorney, Agent, or Firm*—Harness, Dickey & Pierce, P.L.C.

(57) ABSTRACT

A phased array antenna (12) that includes a plurality of multiple spiral arm antenna elements (10). The antenna elements (10) are hexagonal in shape and are aligned in a triangular lattice geometry, where the elements (10) are arranged in rings around a common center element (32). The elements (10) include at least two arms (18, 20) which terminate at opposite sides of the element (10). The ends (26, 28) of the arms (18, 20) of diagonally adjacent elements (10) are positioned proximate to each other to provide inter-element coupling to increase the bandwidth of the antenna (12). The tight coupling of the antenna elements (10) also reduces the RCS of the antenna (12).

20 Claims, 2 Drawing Sheets

CONFORMAL, LOW RCS, WIDEBAND, PHASED ARRAY ANTENNA FOR SATELLITE COMMUNICATIONS APPLICATIONS

BACKGROUND OF THE INVENTION

1. Field of the Invention

This invention relates generally to a phased array antenna including a plurality of spiral arm antenna elements and, more particularly, to a phased array antenna including a plurality of hexagonal shaped, spiral arm antenna elements arranged in concentric rings, where the ends of the arms of diagonally adjacent antenna elements are positioned relative to each other to provide element-to-element coupling to increase the antennas bandwidth.

2. Discussion of the Related Art

Modern tactical military aircraft require radio communications over several frequency bandwidths and communication modes to support the communications, navigation and identification (CNI) functions necessary for operation of the aircraft. These radio frequency (RF) bandwidths generally include the VHF frequency modulation (FM) band (30–88 MHz), the VHF amplitude modulation (AM) band (118–174 MHz) and the UHF band (225–400 MHz). These aircraft also typically include satellite communications systems that support military command, control, communications and intelligence (C3I) functions. These satellite communications signals typically are in the 1–20 GHz frequency range (X, Ku, L-bands).

Suitable antenna systems are necessary to support the various CNI and C3I functions on the aircraft over the several frequency bands of interest. For the high frequency satellite communications functions, a low cost, wideband antenna that supports a plurality of high frequency, circularly-polarized antenna beams is necessary. Common gimbaled, parabolic dish antennas are sufficient to support most of the satellite communications functions for the antenna beams at these frequencies. Such dish antennas are known to be mounted on aircraft, or other vehicles, at a suitable location where a large radome is used to cover the parabolic dish.

The known dish antennas for satellite communications functions have a number of drawbacks when used in military applications, particularly on aircraft. These drawbacks include the fact that a dish antenna is generally limited to only receiving and/or transmitting one antenna beam at any given time. Thus, multiple high gain dish antennas are necessary to support the several satellite communications frequencies. Additionally, wideband circularly-polarized dish antenna feeds are very costly and suffer from poor RF performance. More importantly, modern warfare surface ships, aircraft, and command and control vehicles must have a low radar cross section (RCS), or radar signature, to survive in hostile warfare environments. One or more dish antennas mounted on an aircraft or other military vehicle significantly increases the RCS of the vehicle, making the use of the non-conformal dish antennas undesirable in the warfare environment.

What is needed is a suitable satellite communications antenna for use on military vehicles that is low cost, has a wide bandwidth, simultaneously supports a plurality of antenna beams, and has a low RCS. It is therefore an object of the present invention to provide such an antenna system.

SUMMARY OF THE INVENTION

In accordance with the teachings of the present invention, a phased array antenna is disclosed that includes a plurality of inter-coupled multiple arm spiral antenna elements. The antenna elements are hexagonal in shape and are positioned in a triangular lattice geometry, where the elements are arranged in rings around a common center element. The elements include at least two arms which terminate at opposite sides of the element. The ends of the arms of diagonally adjacent elements are positioned proximate to each other to provide inter-element coupling to increase the bandwidth of the antenna. The tight coupling of the antenna elements also reduces the RCS of the antenna. The antenna is made using conformal load-bearing antenna structure manufacturing technologies to reduce the RCS of the vehicle on which the antenna is mounted.

Additional objects, advantages and features of the present invention will become apparent from the following description and appended claims, taken in conjunction with the accompanying drawings.

DETAILED DESCRIPTION OF THE PREFERRED EMBODIMENTS

The following discussion of the preferred embodiments directed to a phased array antenna including a configuration of hexagonal shaped, multiple spiral arm antenna elements is merely exemplary in nature, and is in no way intended to limit the invention or its applications or uses.

Figure 1:
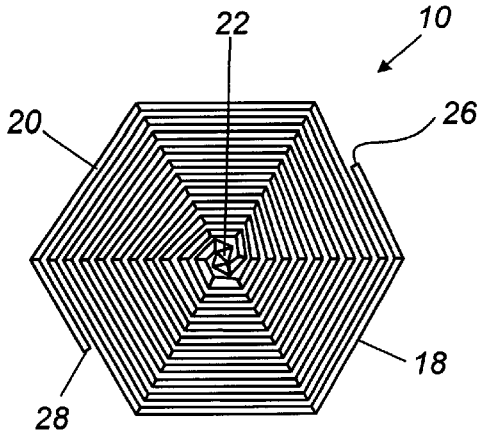
FIG. 1 is a plan view of a hexagonal shaped, multiple arm spiral antenna element for a phased array antenna, according to an embodiment of the present invention.
Figure 2:
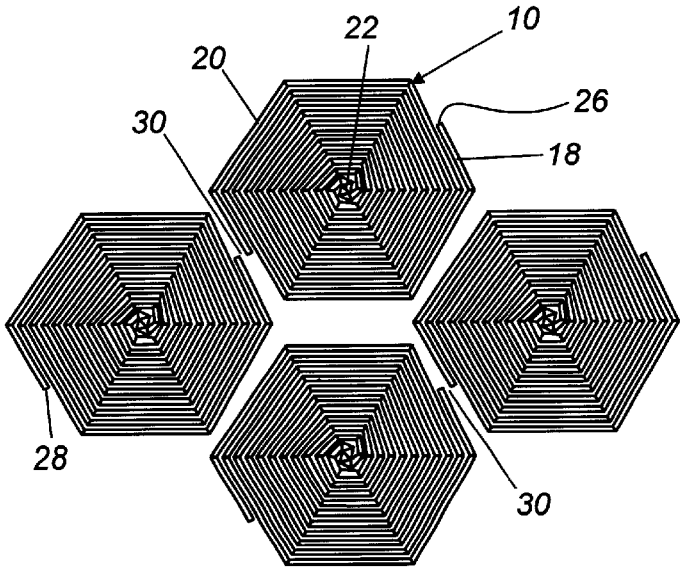
FIG. 2 is a triangular lattice geometry arrangement of four of the antenna elements shown in FIG. 1.
Figure 3:
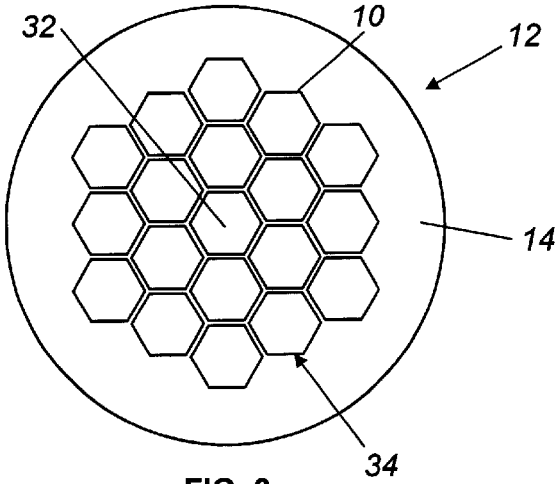
FIG. 3 is a sub-array of a plurality of the antenna elements shown in FIG. 1.

FIG. 1 is a plan view of a hexagonal shaped multiple arm spiral antenna element 10 that is a conformable, low-observable wideband element (CLOWBE), according to an embodiment of the present invention. FIG. 2 is a plan view of four of the antenna elements 10 arranged in a triangular lattice geometry, as will be discussed in detail below. The combination of the elementsl0 discussed herein has a particular application for use in a phased array antenna for simultaneously transmitting and receiving multiple antenna beams, particularly in the frequency range of 1–20 GHz. FIG. 3 shows a sub-array 12 that includes nineteen of the elements 10 patterned on a substrate 14. The sub-array 12 would be part of the larger phased array antenna that provides both transmit and receive functions.

The phased array antenna of the invention can be used for satellite communications purposes on a military vehicle, such as an aircraft, ship, command and control vehicle, etc., and can be formed in the skin of the vehicle to provide a low RCS for the vehicle. For example, the antenna elements 10 can be manufactured with the CLAS manufacturing process, as identified in U.S. patent application Ser. No. 09/178,356, filed Oct. 23, 1998, titled "A Conformal Load-Bearing Antenna System," assigned to the assignee of this application, and herein incorporated by reference. That application discloses an antenna structure that is configured within the skin of an aircraft so that the antenna elements do not increase the RCS of the aircraft. The CLAS manufacturing process allows the antenna elements to be integrated within a composite RF window that carries a load that would have been carried by the replaced skin panel.

The element 10 is a spiral type antenna element that includes two spiral arms 18 and 20 radiating out from a common center 22 in a hexagonal manner. Each of the arms 18 and 20 include outer ends 26 and 28, respectively, ending at opposite sides of the element 10 and opposite the center 22. As would be understood by those skilled in the art, the size of the element 10 determines the frequency range it is sensitive to, and is thus application specific for a particular communications system. In one embodiment, the arms 18 and 20 are center fed by a balun feed (not shown) connected to the center 22. In one embodiment, the substrate 14 is a low-loss duroid and the arms 18 and 20 are printed copper. Any suitable metal deposition process can be used to pattern the elements 10 on the substrate 14.

As shown in FIG. 2, the ends 26 and 28 of diagonally adjacent elements 10 are positioned proximate to each other so that a narrow space 30 is formed therebetween. By positioning the elements 10 relative to each other in this manner, inter-element coupling occurs between the elements 10 which acts to increase the bandwidth of the antenna at the desirable frequency ranges. The ends 26 and 28 are almost touching, and would be spaced from each other a distance determined by the desired bandwidth. Because the elements 10 are hexagonal in shape, and are positioned in the triangular geometry, the sub-array 12 of the elements 10 are able to align in this manner.

The sub-array 12 is defined for maximum inter-element coupling in a triangular lattice geometry. The triangular lattice feature enables the sub-array 12 to symmetrically scan over the designed field-of-view without grating lobes migrating into real, visible space. The inter-element coupling enhances the individual spiral elements low-end frequency performance. Typical antenna performance for an array of similar spirals has been measured from 2.4 GHz to 11.2 GHz.

The sub-array 12 is arranged in "rings" 34 about a common center element 32. The number of the elements 10 in the ring 34 satisfies the characteristic equation, $3n^2-3n+1$, where n is the ring number. A plurality of the sub-arrays 12 are integrated into the final phased array. In addition to the non-resonant characteristics of the element 10, the tight coupling of the elements 10 reduces the RCS when the array of elements 10 is illuminated by radar.

Satellite communications performance requires that antennas of this type are based on the physical size of the aperture capture area of the antenna. Given the aperture area ($10^3$ square-wavelengths) needed to meet these communications requirements, the sub-arrays of the invention are most efficiently implemented using conformal load bearing antenna structures (CLAS) where the antenna structure is used to bear or pass the structural load of the vehicle.

Figure 4:
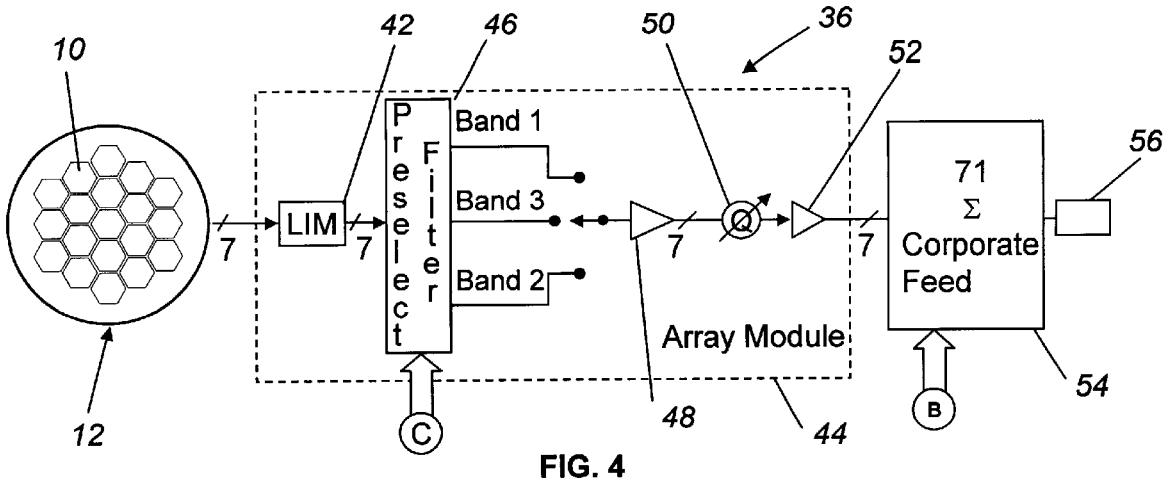
FIG. 4 is a block diagram of a receiver-only architecture for the sub-array shown in FIG. 3.

FIG. 4 is a block diagram of an example of a receiver-only antenna system 36 employing the sub-array 12. In this example, the inner seven elements 10 of the sub-array 12 are fed, and the outer ring 34 of elements 10 are inactive or terminating elements. Different applications would require that some of the elements be inactive elements and some of the elements be driven and fed. The seven feed lines from the sub-array 12 are applied to a power limiter 42 in an array module 44 to limit the power entering the module 44. Because the sub-array 12 is a wideband array, it can receive multiple frequency bands for various satellite communications applications, such as X band, L-band and Ku band.

The signals from the power limiter 42 are applied to a preselect filter 46 that filters the particular frequency band of interest. A control signal "C" is applied to the preselect filter 46 for beam forming purposes. A switch 38 selects one of the three bands from the preselect filter 46, which is then applied to a low noise amplifier 48. The amplified signal from the amplifier 48 is applied to a phase shifter 50 for beam steering and phase weighting purposes, and then to another low noise amplifier 52. The seven input signals from the low noise amplifier 52 are applied to a corporate feed 54 that sums all the signals together. The summed beam from the corporate feed 54 is then applied to a receiver 56.

Figure 5:
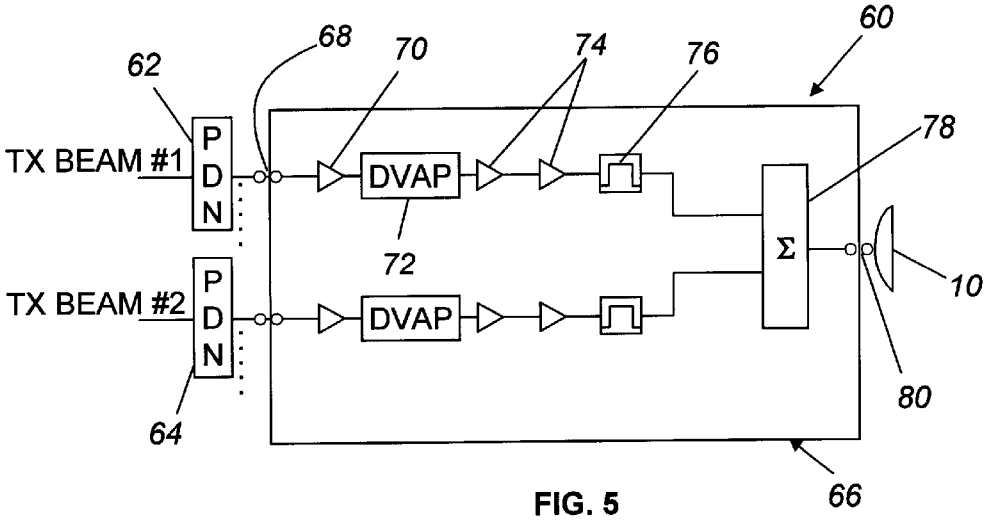
FIG. 5 is a block diagram of a transmit-only architecture for an antenna element of the invention.

FIG. 5 is a block diagram of an example of a transmit-only architecture for an antenna system 60 for each separate antenna element 10. In this example, the element 10 is transmitting two different beams having different frequencies. The first beam is applied to a power divider network (PDN) 62 and the second beam is applied to a PDN 64. The first and second beams come from the transmission devices, such as traveling wavetube amplifiers. Each power divider network 62 and 64 takes the input signal and provides 168 output signals for each of the elements 10 in the array. The path for one of the first beams will be described with the understanding that the other paths are the same.

The signal from the PDN 62 is applied to an RF transition device 68 and a transmit module 66. The beam is applied to a power amplifier 70 in the module 66, and then to a phase shifting device 72 that provides phase weighting for that particular beam. Next, the beam is applied to two power amplifiers 74, and then to a band pass filter (BPF) 76. The BPF 76 limits the frequency of the beam to be transmitted. The beams from the two transmission paths are then sent to a summation device 78 that sums the beams. The beam is then sent through an RF of transition device 80 to the element 10 for transmission. The element 10 is one element of the overall array of 168 elements.

Figure 6:
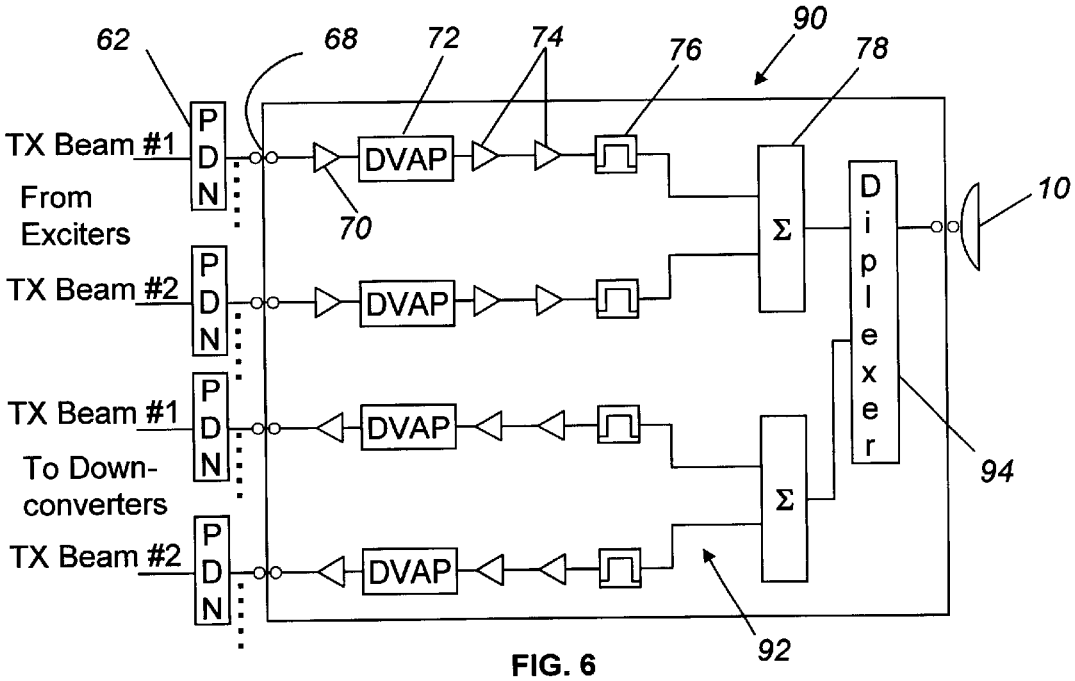
FIG. 6 is a block diagram of both the transmit and receiver architectures for the antenna element of the invention.

FIG. 6 is a block diagram of a transmit-receive architecture 90 for an element 10 of the invention. The architecture 90 includes the transmit-only architecture 60 discussed above, and is thus labeled accordingly. In addition, the architecture 90 includes the same components for a receiver architecture 92. A diplexer 94 is used to separate the transmitter receive functions from the element 10.

The foregoing discussion discloses and describes merely exemplary embodiments of the present invention. One skilled in the art will readily recognize from such discussion and from the accompanying drawings and claims, that various changes, modifications and variations can be made therein without departing from the spirit and scope of the invention as defined in the following claims.

What is claimed is:

1. An antenna system comprising:

a substrate; an array antenna, said array antenna including a plurality of antenna elements patterned on the substrate to define an array of elements, where each antenna element includes at least two spiral arms radiating out from a center location, each of the two spiral arms including outer ends terminating at opposite sides of the element, said antenna elements being arranged so that the outer ends of arms on opposing sides of diagonally adjacent elements substantially directly oppose each other and are closely spaced so as to provide electromagnetic coupling between the elements and increase the bandwidth of the antenna, wherein the outer ends of the arms of diagonally adjacent elements are substantially located on a line extending through the center of the diagonally adjacent elements; and a transceiver connected to the antenna and providing phase weighting for the array of elements.

2. The system according to claim 1 wherein each of the antenna elements is a hexagonal shaped element.

3. The system according to claim 1 wherein the elements are arranged in the array in a triangular lattice geometry.

4. The system according to claim 1 wherein the elements are arranged in concentric rings around a center element.

5. The system according to claim 4 wherein the number of elements in each ring is defined by the equation $3n^2-3n+1$, where n is the ring number.

6. The system according to claim 4 wherein an outer ring of elements are inactive elements that are not fed and the remaining elements are active elements that are fed.

7. The system according to claim 1 wherein each antenna element includes only two arms radiating out from the center.

8. The system according to claim 1 wherein the antenna is sensitive to signals in the frequency range of 2.4–11.2 GHz.

9. The system according to claim 1 wherein the antenna system is part of a satellite communications system.

10. An antenna system for transmitting and receiving signals greater than 1 GHz, said system comprising:

a substrate;

an array antenna including a plurality of antenna elements where each element is patterned on the substrate and has a hexagonal shape, said elements being configured in an array of elements, each antenna element including two spiral arms radiating out from a center location of the element where each arm includes an outer end terminating at opposite sides of the element, said antenna elements being arranged in a triangular lattice geometry so that the outer ends of arms on opposing sides of diagonally adjacent elements substantially directly oppose each other in close proximity to provide electromagnetic coupling between the elements to increase the bandwidth of the array antenna, said antenna elements further being arranged in concentric rings around a center element; wherein the outer ends of the arms of diagonally adjacent elements are substantially located on a line extending through the center of the diagonally adjacent elements; and a transceiver connected to the antenna and providing phase weighting for the array of elements.

11. The system according to claim 10 wherein the number of elements in each ring is defined by the equation $3n^2-3n+1$, where n is the ring number.

12. The system according to claim 10 wherein an outer ring of elements are inactive elements that are not fed and the remaining elements are active elements that are fed.

13. The system according to claim 10 wherein the array antenna is configured within a structural component of a vehicle.

14. The system according to claim 12 wherein the array antenna is formed within an aircraft component.

15. The system according to claim 10 wherein the antenna system is part of a satellite communications system.

16. An array antenna including a plurality of antenna elements patterned on a substrate and arranged in an array, each antenna element including two spiral arms radiating out from a center location, said antenna elements being hexagonal shaped elements where the elements are arranged in a triangular lattice geometry so that outer ends of the arms on opposing sides of diagonally adjacent elements substantially directly oppose each other and are closely spaced so as to provide electromagnetic coupling between the elements and increase the bandwidth of the antenna, wherein the outer ends of the arms of diagonally adjacent elements are substantially located on a line extending through the center of the diagonally adjacent elements.

17. The system according to claim 16 wherein the elements are arranged in concentric rings around a center element.

18. The system according to claim 17 wherein the number of elements in each ring is defined by the equation $3n^2-3n+1$, where n is the ring number.

19. An antenna system comprising:

an array antenna, said array antenna including a plurality of antenna elements defining an array of elements, where each antenna element includes at least two spiral arms radiating out from a center location, each of the two spiral arms including outer ends terminating at opposite sides of the element, said antenna elements being arranged so that the outer ends of arms on the same side of diagonally adjacent elements oppose each other to provide electromagnetic coupling between the elements, wherein the elements are arranged in concentric rings around a center element and wherein an outer ring of elements are inactive elements that are not fed and the remaining elements are active elements that are fed; and a transceiver connected to the antenna and providing phase weighting for the array of elements.

20. The system according to claim 19 wherein each of the antenna elements are hexagonal shaped elements and are arranged in the array in a triangular-shaped geometry.

* * * * *